US005653071A

United States Patent [19]

Iwami et al.

[11] Patent Number: 5,653,071

[45] Date of Patent: Aug. 5, 1997

[54] TIRE SLIP PREVENTING CONSTRUCTION FORMED ON FLOOR PLATE

[75] Inventors: Takaharu Iwami; Geniti Iwami, both of Kyoto, Japan

[73] Assignee: Naigai Technica Co., Limited, Kyoto, Japan

[21] Appl. No.: 242,629

[22] Filed: May 13, 1994

[30] Foreign Application Priority Data

May 17, 1993 [JP] Japan ..... 5-139374

[51] Int. Cl.[6] ..... E04B 5/00; E04H 6/10

[52] U.S. Cl. ..... 52/181; 52/177; 52/630

[58] Field of Search ..... 52/630, 175, 177–181, 52/789.1; 404/19–21

[56] References Cited

U.S. PATENT DOCUMENTS

| | | | |
|---|---|---|---|
| 629,951 | 8/1899 | Brown | 52/181 |
| 937,415 | 10/1909 | Cairns | 404/19 X |
| 1,091,214 | 3/1914 | Gruber | 52/177 X |
| 1,263,755 | 4/1918 | Gamble et al. | 52/181 |
| 1,410,945 | 3/1922 | Mayfield | 52/630 X |
| 1,441,327 | 1/1923 | Blum | 52/177 |
| 2,106,399 | 1/1938 | Beaumont et al. | 52/177 |
| 2,180,317 | 11/1939 | Davis | 52/630 X |
| 2,670,060 | 2/1954 | Fenske | 52/181 |
| 3,049,198 | 8/1962 | Dobbins et al. | 52/630 |
| 3,093,216 | 6/1963 | Dunhany | 404/19 X |
| 3,724,078 | 4/1973 | Carlin et al. | 52/177 |
| 4,194,330 | 3/1980 | Smith | 52/177 |
| 4,709,519 | 12/1987 | Liefer et al. | 52/177 X |
| 4,840,824 | 6/1989 | Davis | 52/181 X |

FOREIGN PATENT DOCUMENTS

| | | | |
|---|---|---|---|
| 0534306 | 1/1955 | Belgium | 52/630 |
| 0024504 | of 1922 | France | 52/177 |
| 1389650 | 1/1965 | France | 52/177 |
| 2619128 | 11/1976 | Germany | 52/177 |
| 0031120 | of 1904 | Switzerland | 52/177 |
| 0486618 | 4/1970 | Switzerland | 52/177 |
| 0008431 | of 1910 | United Kingdom | 52/177 |
| 177623 | 4/1922 | United Kingdom | 52/630 |

*Primary Examiner*—Robert Canfield

*Attorney, Agent, or Firm*—Armstrong, Westerman, Hattori, McLeland & Naughton

[57] ABSTRACT

A tire slip-preventing construction formed on a floor plate to be installed as a floor surface of a self-running type sky parking-place or as a surface of a road being repaired comprising a floor plate main body made of a rectangular steel plate. A plurality of slip preventing portions is formed on the upper surface of the floor plate main body as a slip preventing portion. The projection portion comprises a first projection and a second projection extending from a certain point disposed on the first projection toward a certain point disposed on the upper surface of the floor plate main body. Preferably, the first projection, the second projection, and the floor plate main body are integral with each other. As the slip preventing portion, a sheet-shaped slip preventing material layer comprising silica sand and a coating material may be formed on a concave formed in the floor plate main body.

19 Claims, 10 Drawing Sheets

TIRE SLIP PREVENTING CONSTRUCTION FORMED ON FLOOR PLATE

BACKGROUND OF THE INVENTION

1. Field of the Invention

The present invention relates to a tire slip-preventing construction formed on a floor plate, and more particularly to a tire slip-preventing construction formed on a floor plate to be installed as the floor surface of a second floor of a self-running type sky parking-place or as the surface of a road being repaired.

2. Description of the Prior Art

A sky parking-place of self-running type is constructed with a plurality of pillars standing on the ground. H-sections are installed X-direction (lengthwise and widthwise directions) and Y-direction (vertical direction) on upper portions of the pillars. A plurality of flat or flat long floor plates are installed on horizontal spaces surrounded with the H-sections in such a manner that the floor plates cover the spaces. In this manner, the floor surface of a second floor of the sky parking-place is constructed. A plurality of projections is formed on the upper surface of the floor plates to prevent tires of cars from slipping thereon on rainy days in particular.

FIG. 14 is a perspective view, with a principal portion broken away in section, showing an example of a conventional tire slip-preventing construction formed on a floor plate. FIG. 15 is a sectional view showing a principal portion of the floor plate of the tire slip-preventing construction shown in FIG. 14. A plurality of projections 2 for preventing a tire slip is formed on the upper surface of a floor plate 1. The projection 2 is approximately semicircular in section. Although only one projection 2 is shown in FIGS. 14 and 15, a plurality of projections 2 are formed on the upper surface of the floor plate 1.

FIG. 16 is a perspective view, with a principal portion broken away, showing another example of a conventional tire slip-preventing construction formed on a floor plate. FIG. 17 is a sectional view showing a principal portion of the floor plate of the tire slip-preventing construction shown in FIG. 16. A plurality of circular holes 3 is formed on the floor plate 1 by burring to form a plurality of approximately ring-shaped projections 4 on the floor plate 1. In some conventional tire slip-preventing constructions, the hole 3 is elliptic or slot-shaped. The floor plate 1 shown in FIG. 16 prevents tires from slipping thereon by means of the projections 4.

FIG. 18 is a sectional view showing another example of a conventional tire slip-preventing construction formed on a floor plate. A plurality of projections 5 approximately semicircular in section is formed on the upper surface of the floor plate 1. The height of the projection 5 is greater than that of the above-described projections 2 and 4. One side of the projection 5 is integral with the floor plate 1 while the other side thereof is not connected with the floor plate 1. That is, the thickness of the projection 5 is set to be greater than that of the floor plate 1 so as to prevent a tire slip effectively.

As described above, projections in various configurations are formed on the upper surface of a floor plate so as to prevent a tire from slipping thereon.

The above-described conventional tire slip-preventing constructions have the following problems:

That is, because the projection 2 of the conventional tire slip-preventing construction shown in FIGS. 14 and 15 is approximately circular, the coefficient of friction of the projection 2 is low. Therefore, tires are apt to slip on the floor plate 1 on rainy days in particular. That is, the tire slip-preventing construction hardly perform its function.

In the conventional tire slip-preventing construction shown in FIGS. 18 and 17, in order to allow the tire slip-preventing construction to perform its function very efficiently, the periphery of the projection 4 forms a large angle with the upper surface of the floor plate 1 to make the projection 4 high. Therefore, in curving the periphery of the projection 4, the periphery is cracked because stress is generated in the periphery of the projection 4. As a result of repeated collisions between tires and the projection 4, the projection 4 is cracked in a greater extent, with the result that the projection 4 is broken. That is, the tire slip-preventing construction becomes unfunctional. Further, the breakage of the projection 4 leads to the cracking of the floor panel 1.

Moreover, because a plurality of holes 3 are formed on the floor panel 1, rain drops downstairs through the holes 3.

Because the projection 4 is formed by burring, the upper edge thereof is pointed as shown in FIG. 17. There is a great possibility that tires are damaged by the projection 4 when a handle of a car is turned to start the car, with tires placed on the projections 4, because power steering is adopted in most of cars in recent years. If the collisions between the tires and the projection 4 are repeated, the tires are cracked, and thus they are punctured.

In the conventional tire slip-preventing construction shown in FIG. 18, the projection 5 is approximately semicircular and the height thereof is greater than that of the projections 2 and 4. Thus, the tire slip-preventing construction is superior to those shown in FIGS. 14 through 17 in the function of preventing tires from slipping.

Because the height of the projection 5 is great, the projection 5 causes a car to be shaken vertically in a great extent when a car travels on the projection 5. As a result, the car bounds and the entire floor plate 1 is shaken, which causes the floor surface to be shaken. Consequently, great noises are generated, thus giving nuisance to people in the neighborhood at night in particular. In addition, as shown in FIG. 18, rainwater drops downstairs through a gap 6 between the projection 5 and the upper surface of the floor plate 1.

SUMMARY OF THE INVENTION

It is accordingly an object of the present invention to provide a tire slip-preventing construction, formed on a floor plate, which reliably prevents a tire of a car from slipping and is capable of preventing rainwater from dropping downstairs.

In accomplishing these and other objects of the present invention, there is provided a tire slip-preventing construction formed on a floor plate comprising a floor plate main body; and a slip preventing portion formed on an upper surface of the floor plate main body. The slip preventing portion includes a plurality of projection portions. A part of corners of each projection portion forms 90°.

Preferably, the projection portion comprises a first projection formed on the upper surface of the floor plate main body; and a second projection formed on the upper surface of the first projection portion and that of the floor plate main body, with the second projection extending from a certain point disposed on one side of the first projection toward a certain point disposed on the upper surface of the floor plate main body. The first projection may comprise a wide portion disposed on one side thereof and a narrow portion disposed on the other side thereof. Both side surfaces of the narrow portion are inclined symmetrically.

Preferably, a plurality of the projection portions forming a group is arranged dot-symmetrically. A plurality of the projection portions forming a group may be arranged dot-symmetrically, with the second projections directed toward the center of dot-symmetry. Preferably, four projection portions forming a group is arranged dot-symmetrically, with the second projections directed toward the center of dot-symmetry. Preferably, a plurality of groups each consisting of a plurality of the projection portions is formed at regular interval on the upper surface of the floor plate main body in a lengthwise direction thereof.

A plurality of the floor plate main bodies narrow and long is arranged to form a floor surface. A plurality of groups each consisting of four projection portions forming a group is formed continuously on the upper surface of each of the floor plate main bodies in a lengthwise direction thereof.

Each projection portion comprises two projections in which corners extending in a lengthwise direction form 90°. The two projections may be arranged in approximately a T-configuration. A plurality of groups each consisting of the two projections may be arranged dot-symmetrically on the upper surface of the floor plate main body. Preferably, four groups each consisting of the two projections are arranged dot-symmetrically on the upper surface of the floor plate main body. Preferably, a plurality of groups each consisting of the two projection portions is formed at regular interval on the upper surface of the floor plate main body in a lengthwise direction thereof.

A plurality of the floor plate main bodies narrow and long is arranged to form a floor surface; and a plurality of groups each consisting of the two projections forming a group may be formed continuously on the upper surface of each of the floor plate main bodies in a lengthwise direction thereof.

Only one end of the projection portion may be projected from the upper surface of the floor plate main body.

Preferably, the floor plate main body is made of a steel plate and the projection portion is formed by drawing. The thickness of the projection portion is approximately half of that of floor plate main body. Preferably, at least four groups each consisting of a plurality of the projection portions is formed simultaneously by drawing.

The slip preventing portion comprises a slip preventing material layer formed on the upper surface of the floor plate main body.

Preferably, the slip preventing material layer is formed on a concave portion formed on the upper surface of the floor plate main body. Preferably, the slip preventing material layer is formed on the concave portion so that the slip preventing material layer projects from the upper surface of the floor plate main body.

The upper surface of the slip preventing material layer may be flush with the upper surface of the floor plate main body. The slip preventing material layer comprises silica and a coating material; and formed as a sheet.

Preferably, a plurality of groups each consisting of a plurality of the concave portions is arranged dot-symmetrically. The concave portion may comprise two concaves rectangular in section; and the two concaves may be arranged in approximately a T-configuration.

According to the present invention, the slip preventing portion is formed on the upper surface of the floor plate main body. Therefore, a tire slip can be prevented. A part of corners of each projection portion forms 90°. Accordingly, unlike the conventional curved projections, tires are brought into contact with the perpendicular portion of the projection portion and as a result, the floor plate main body has a great coefficient of friction, thus preventing a tire slip. The tire slip-preventing construction is effective for preventing a tire slip on rainy days in particular. Because the projection portion is formed on the floor plate main body, the floor plate main body has itself a high strength. Further, the floor plate main body is flexed in a small degree, and hence shaken in a small degree. In addition, unlike the conventional art, holes are not formed by burring but by drawing. Thus, plastic deformation is not generated by strain or concentrated stress is not generated, either.

Because the projection portion has two steps consisting of the first and second projections, the floor plate main body has a great coefficient of friction, thus preventing a tire slip. The tire slip-preventing construction is effective for preventing a tire slip very effectively. Four projection portions forming a group are arranged dot-symmetrically, with the second projections opposed to each other, thus preventing a tire slip in all directions. Therefore, in arranging a plurality of floor plates to form a floor surface, the floor plates can be arranged with efficiency because there is no limitation in the arranging direction of the floor plates.

Only one end of the projection portion is projected from the upper surface of the floor plate main body. Accordingly, the projection portion can be formed easily on the upper surface of the floor plate main body. The floor plate main body is made of a steel plate, and the projection portion is formed by drawing. Accordingly, the projection portion can be formed easily on the upper surface of the floor plate main body. The thickness of the projection portion is comparative thin, namely, approximately half of that of floor plate main body. Thus, unlike the conventional tire slip-preventing construction, when tires are brought into contact with the projection, cars do not bound, and consequently the floor plate main body can be prevented from being shaken although the projection portion has two steps consisting of the first and second projections.

When the projection portion is formed by drawing, needless to say, the entire thickness of the projection portion which is the addition of the thickness of the projection portion and that of the floor plate main body is greater than that of floor plate main body. Therefore, plastic deformation is not generated by strain or concentrated stress is hard to be generated in the periphery of the projection portion. Consequently, cracks are not generated in the projection portion and in portions, of the floor plate main body, in the periphery of the projection portion.

When the projection portion is formed by drawing, rainwater does not drop downstairs, unlike the conventional tire slip-preventing construction having holes or gaps formed on the floor plate.

Four groups or more each consisting of a plurality of projection portions are formed simultaneously on the upper surface of the floor plate main body by drawing. This method allows the projection portions to be formed in a shorter time period than a method of forming them one by one.

The above and further objects, features, aspects and advantages of the present invention will be more fully apparent from the following detailed description with the accompanying drawings.

DESCRIPTION OF THE PREFERRED EMBODIMENTS

An embodiment of the present invention is described below with reference to the drawings.

Figure 1:
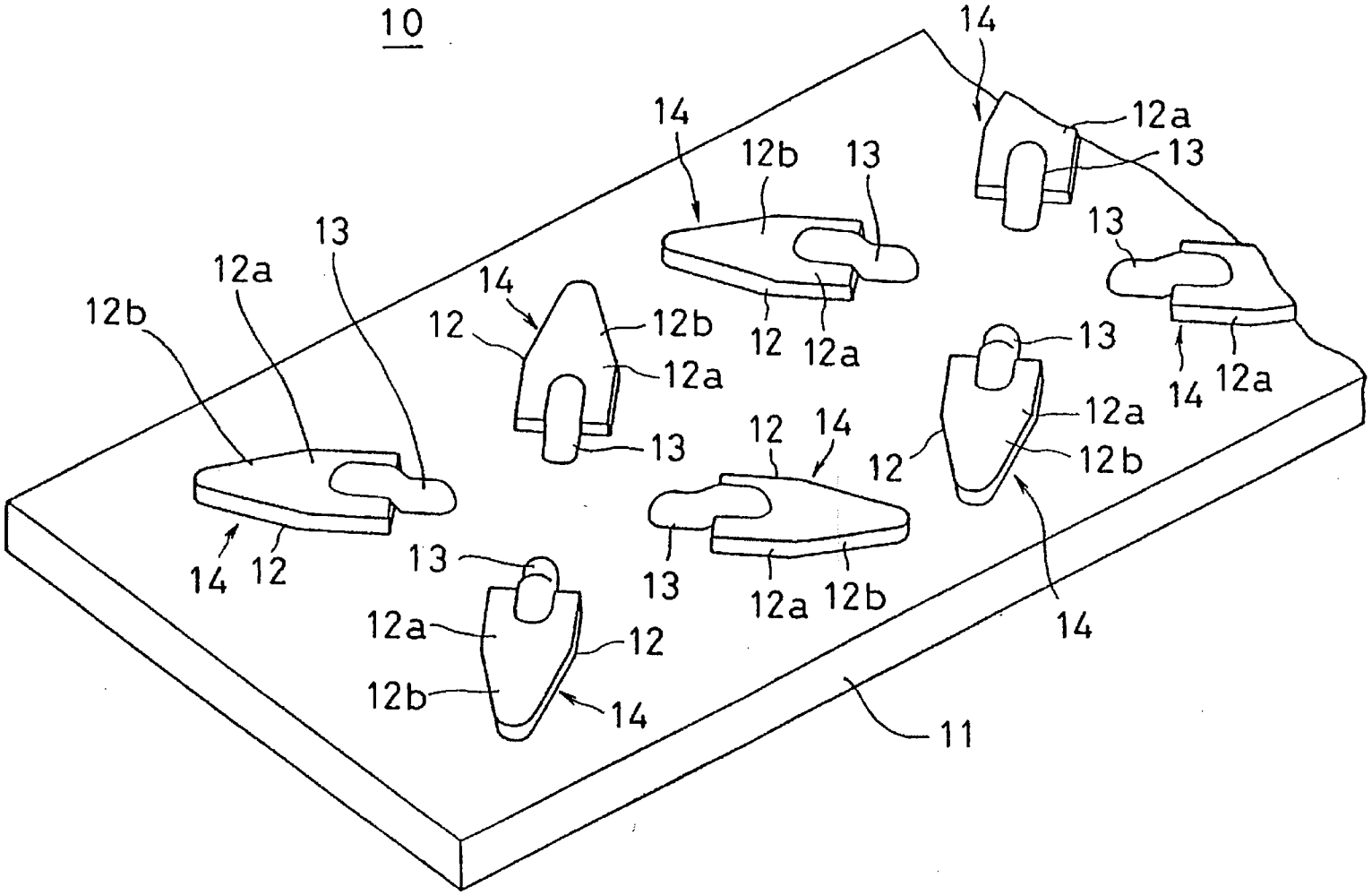
FIG. 1 is a perspective view showing principal portions of a tire slip-preventing construction according to an embodiment of the present invention.
Figure 2:
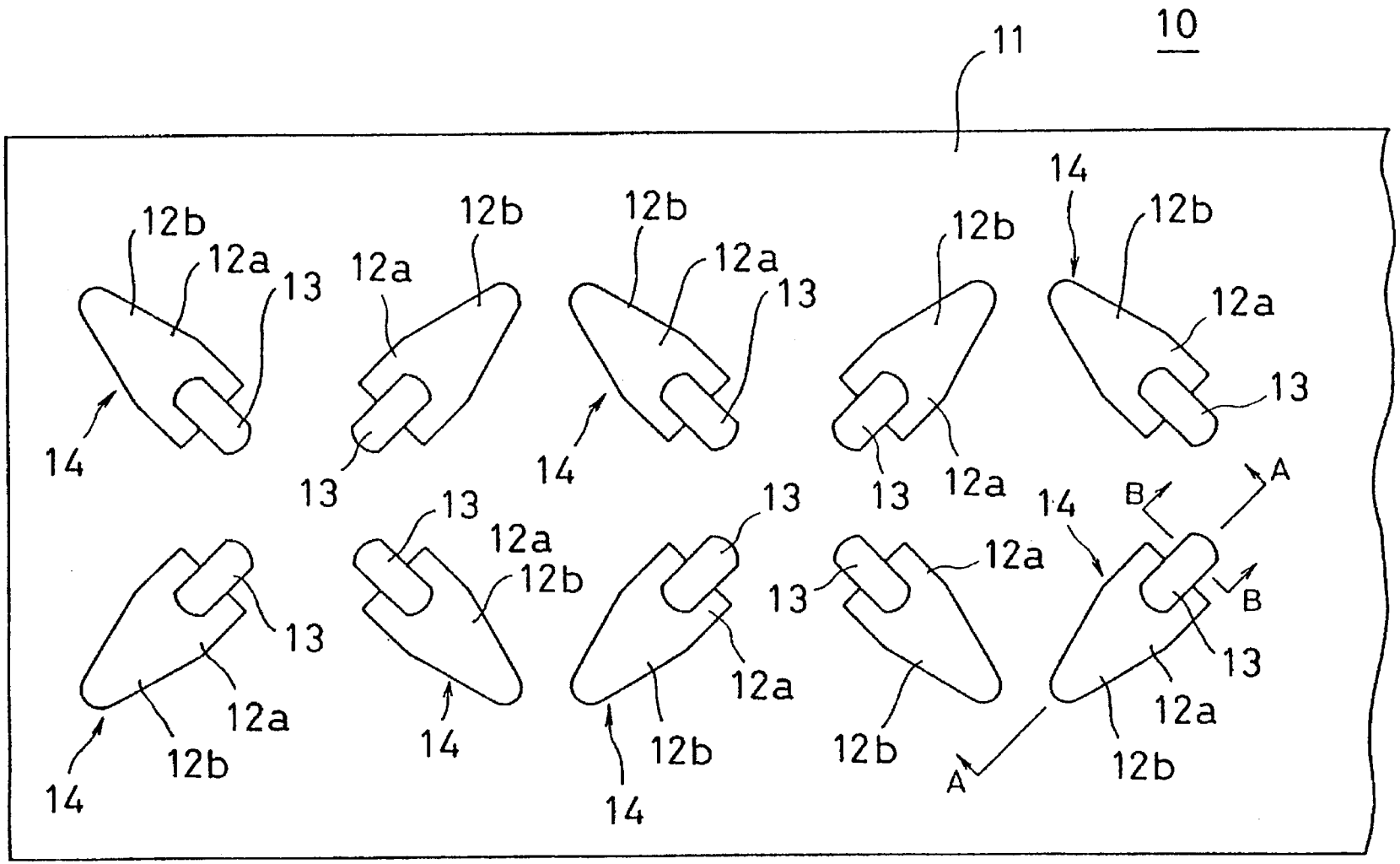
FIG. 2 is a plan view showing principal portions of a floor plate of the tire slip-preventing construction shown in FIG. 1.
Figure 3:
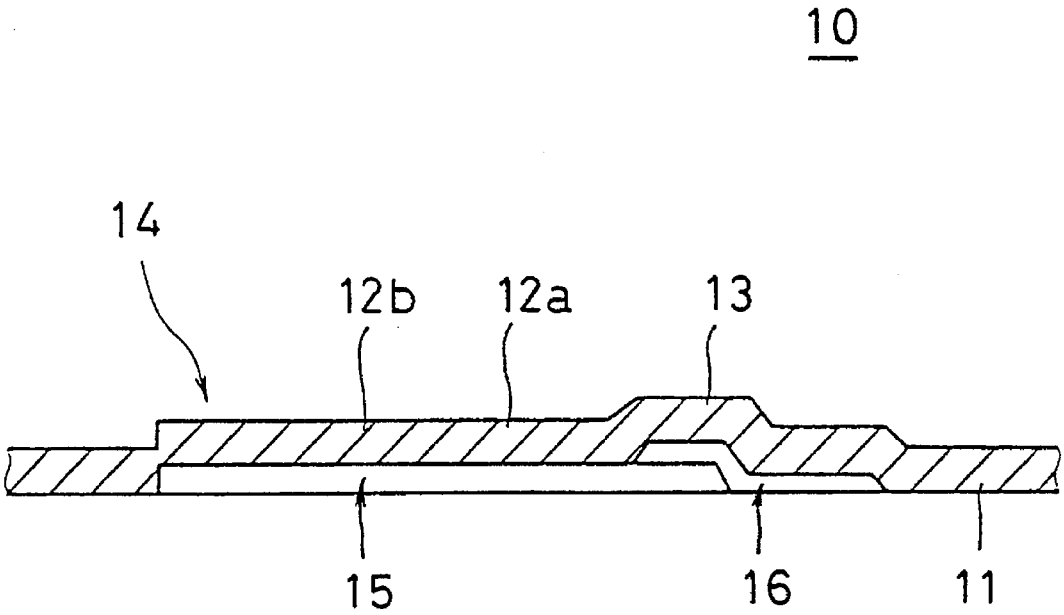
FIG. 3 is a sectional view, showing the floor plate, taken along a line A—A of FIG. 2.
Figure 4:
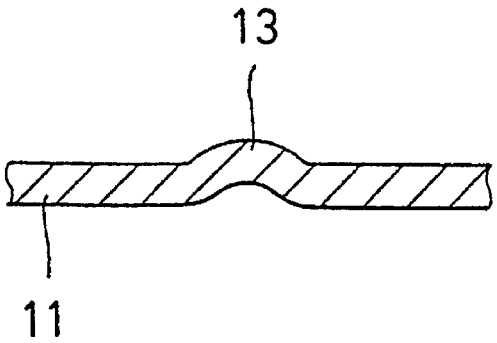
FIG. 4 is a sectional view, showing the floor plate, taken along a line B—B of FIG. 2.

FIG. 1 is a perspective view showing principal portions of a tire slip-preventing construction according to an embodiment of the present invention. FIG. 2 is a plan view showing principal portions of a floor plate of the tire slip-preventing construction shown in FIG. 1. FIG. 3 is a sectional view, showing the floor plate, taken along a line A—A of FIG. 2. FIG. 4 is a sectional view, showing the floor plate, taken along a line B—B of FIG. 2. A floor plate which is described below is installed on the floor surface of a second floor of a sky parking-place.

A floor plate 10 comprises a floor plate main body 11 having an appropriate length and made of a long flat steel plate. A plurality of floor plates 10 is arranged to form the floor surface of the second floor.

A plurality of slip-preventing projection portions 14 are formed, as a slip-preventing portion, on the upper surface of the floor plate main body 11. A plurality of groups each consisting of four projection portions 14 are formed on the upper surface of the floor plate main body 11 in the lengthwise direction thereof, with the projection portions 14 spaced at regular intervals.

The projection portion 14 comprises a first projection 12 and a second projection 13. The first projection 12 comprises a wide portion **12*a* and a narrow portion 12*b*. The wide portion 12*a* is approximately rectangular in a plan view. The wide portion 12*a* integral with the floor plate main body 11 projects upward from the upper surface thereof. The narrow portion 12*b* triangular in a plan view and integral with the wide portion 12*a* is formed on one end of the wide portion 12*a* in the widthwise direction thereof. In other words, approximately ⅓ of the projection portion 14 in the lengthwise direction thereof is wide, and approximately ⅔ thereof in the lengthwise direction is narrow. That is, both sides of the narrow portion 12*b* are symmetrically inclined, i.e., the narrow portion 12*b*** is tapered toward one end thereof.

The second projection 13 is formed on the projection portion 14 and the floor plate main body 11 in a predetermined length from a certain position on one side of the projection portion 14 toward a certain position of the floor plate main body 11. That is, the second projection 13 extends in a Z-configuration from a certain position of the wide portion **12*a* toward a certain position of the floor plate main body 11, as shown in FIG. 1. As shown in FIG. 4, the second projection 13 is approximately semicircular in section. The second projection 13 integral with the first projection 12 is projectingly formed on the upper surface of the floor plate main body 11. That is, the projection portion 14 has two steps consisting of the first projection 12 and the second projection 13**.

Four projection portions 14 forming one group are disposed on the floor plate main body 11 in a petal configuration, i.e, they are dot-symmetrical. In other words, the four projection portions 14 form approximately an X-configuration. One end of the second projection 13 disposed on the floor plate main body 11 is directed toward the center of dot-symmetry. As described above, the projection portions 14 are spaced at regular intervals on the floor plate main body 11 in the lengthwise direction thereof, with four projection portions 14 forming one group.

A press machine is used to form the projection portions 14 by drawing. In this embodiment, four groups each consisting of four projection portions 14 are formed simultaneously by drawing. The projection portions 14 may be formed one by one. It is also possible to form one group consisting of four projection portions 14 simultaneously by drawing. It is also possible to form two or three groups or more than four groups simultaneously by drawing.

As shown in FIG. 3, in forming the projection portion 14 by drawing, a first concave 15 is formed on the underside of a portion of the floor plate main body 11 opposed to the first projection 12 in correspondence to the projection amount (thickness) of the first projection 12, and a second concave 16 is formed on the underside of a portion of the floor plate main body 11 opposed to the second projection 13. In this embodiment, the second concave 16 is formed such that the second concave 16 communicates with the first concave 15 in a range from the underside of the first projection 12 to the underside of the floor plate main body 11.

In this embodiment, the thickness of the floor plate main body 11 is 3 mm. The projection amount (thickness) of the first projection 12 of the projection portion 14 is 2 mm, and the thickness of the second projection 13 thereof is 1.5 mm. The thickness of the projection portion 14 is obtained by adding the thickness of the first projection 12 and that of the second projection 13 to each other. Thus, the thickness of the projection portion 14 is approximately half of the thickness of the floor plate main body 11. In this embodiment, the maximum thickness of the projection portion 14, namely, the maximum length from the upper surface of the floor plate main body 11 to that of the projection portion 14 is 3.5 mm and thus larger than the thickness of the floor plate main body 11. Accordingly, the floor plate 10 has a great coefficient of friction and is hence effective for preventing tires of cars from slipping on the floor plate main body 11.

As described above, the first projection 12 and the second projection 13 are projectingly formed on the upper surface of the floor plate main body 11 by drawing. Therefore, the entire thickness of the floor plate 10 is equal to the addition of the thickness of the first projection 12, that of the second projection 13, and that of the floor plate main body 11. That is, the thickness of the floor plate 10 is greater than that of the floor plate main body 11. Accordingly, concentrated stress is hard to be generated in the first projection 12 and the second projection 13 and plastic deformation is not generated in the periphery thereof by strain. Therefore, cracks are not generated in the first projection 12, the second projection 13, and portions, of the floor plate main body 11, disposed in the periphery of the first and second projections 12 and 13.

Because holes or gaps are not formed in the periphery of the first and second projections 12 and 13, rainwater does not drop downstairs.

In this embodiment, the first and second projections 12 and 13 are formed simultaneously by drawing, but the second projection 13 may be formed by drawing after the first projection 12 is formed.

The thickness of the first projection on 12 and that of the second projection 13 are not limited to the above-described numerical values but may be appropriately altered.

In this embodiment, four projection portions 14 forming one group are disposed in approximately an X-configuration as shown in FIGS. 1 and 2. It is possible to change the direction of the projection portions 14. For example, the four projection portions 14 may form an approximately cross configuration in a plan view by rotating them 45° clockwise or counterclockwise. Further, the projection portions 14 may be rotated by 180° so as to dispose the second projection 13 on the outer side thereof, namely, to direct the leading end of the narrow portions **12*b*** toward the center of dot-symmetry.

Of various directions and dispositions of the projection portions 14, those shown in FIGS. 1 and 2 are most favorable.

Although one end of the projection portions 14 is narrowed, the first projection 12 may be rectangular or square to make the projection portions 14 rectangular or square. It is also possible to form more than four second projections 13 on the first projection 12. For example, the second projection 13 may be formed on both sides of the first projection 12 either in the lengthwise or widthwise direction of the first projection 12. It is also possible to form the second projection 13 on each side of the first projection 12.

The projection portion 14 has two steps on the floor panel main body 11 owing to the formation of the first and second projections 12 and 13. Therefore, the floor plate 10 has a great coefficient of friction and is hence effective for preventing a tire slip. In impact tests conducted by the present inventors, no cracks were generated in the projection portion 14 when it was subjected to about twice as many as the number of times of impacts at which cracks were generated in the projection 4 of the above-described conventional tire slip-preventing construction.

In this embodiment, the projection portion 14 is formed on the floor plate main body 11 of the floor plate 10; the thickness of the first projection 12 is greater than that of the floor plate main body 11; the thickness of the second projection 13 is smaller than that of the first projection 12, and no through holes or through gaps are formed in the floor plate main body 11. Therefore, rainwater never drops downstairs through the floor plate main body 11.

Figure 5:
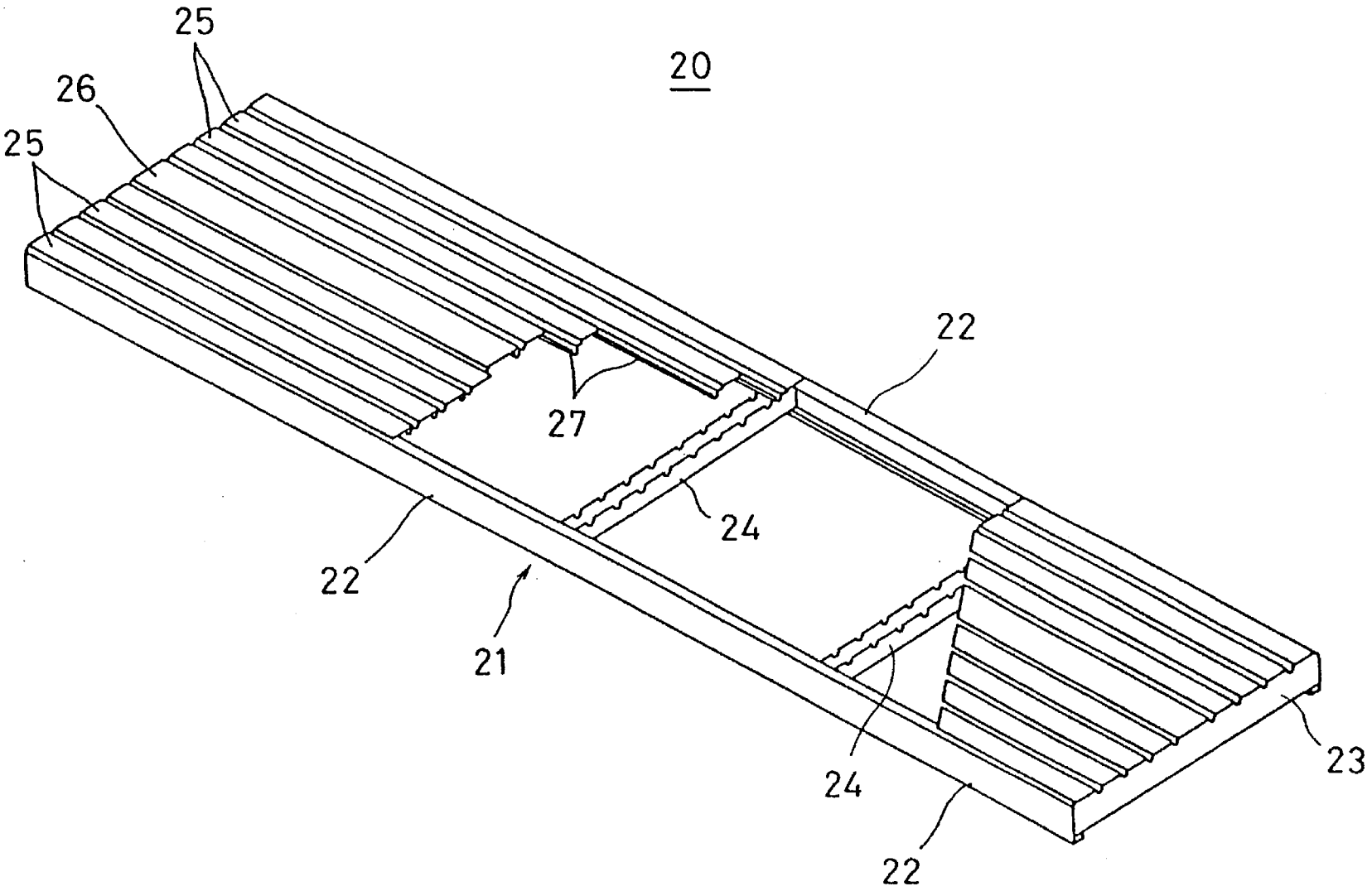
FIG. 5 is a perspective view, with parts broken away in section, showing a floor panel comprising a modified floor plate of the floor plate shown in FIGS. 1 through 4.

FIG. 5 is a perspective view, with parts broken away in section, showing a floor panel comprising a floor plate modified from the floor plate 10 shown in FIGS. 1 through 4. Although the floor plate 10 shown in FIGS. 1 through 4 is flat, but may be composed of floor plates 25 and 28 as shown in FIG. 5.

That is, a floor panel 20 comprises a rectangular frame 21 including two lengthwise frames 22 spaced at a predetermined interval. Each lengthwise frame 22 is rectangular in a plan view and one-side lacking rectangular in section. A pair of side plates 23 extending in the widthwise direction of the frame 21 is disposed at both lengthwise ends of the lengthwise frames 22. Three crossrails 24 which are upper side-lacking rectangular in section are disposed widthwise between both lengthwise frames 22 and installed thereon, with predetermined intervals spaced from each other and from both side plates 23 in the lengthwise direction of the frame 21. That is, the frame 21 is constituted of the two lengthwise frames 22, the two side plates 23, and the three crossrails 24.

A floor plate 26 and a plurality of floor plates 25 are installed on the frame 21 to cover the frame 21. The floor plate 26 which is lower side-lacking rectangular in section is disposed in the center of the frame 21 in the widthwise direction thereof. A sectionally U-shaped concave 27 is formed on one end of each floor plate 25 in the widthwise direction thereof, with the concave 27 extending through the whole length in the lengthwise direction of the floor plate 25. The concave 27 is not formed on the floor plate 26. The floor plates 25 are installed on the frame 21 from both sides thereof toward the center in the widthwise direction thereof. After all the floor plates 25 are installed on the frame 21, the floor plate 26 is installed thereon. In this manner, the floor panel 20 is constructed.

The floor panel 20 is installed on a space surrounded with lengthwise and widthwise H-sections, thus forming the floor surface of a second floor of a sky parking-place.

Rainwater which has dropped to the floor panel 20 is discharged to the outside through the concaves 27, holes (not shown) formed on the concaves 27, the crossrails 24 which receive rainwater which has dropped from the holes, drainage grooves (not shown) formed on the inner side of the lengthwise frames 22 so as to receive rainwater which has dropped from the widthwise ends of the crossrails 24, and drainage grooves (not shown) formed on the inner side of the side plates 23. Although projections are not shown on the floor plates 25 and 26 shown in FIG. 5, they have the projection portions 14 formed thereon, similarly to the embodiment shown in FIGS. 1 through 4.

Figure 6:
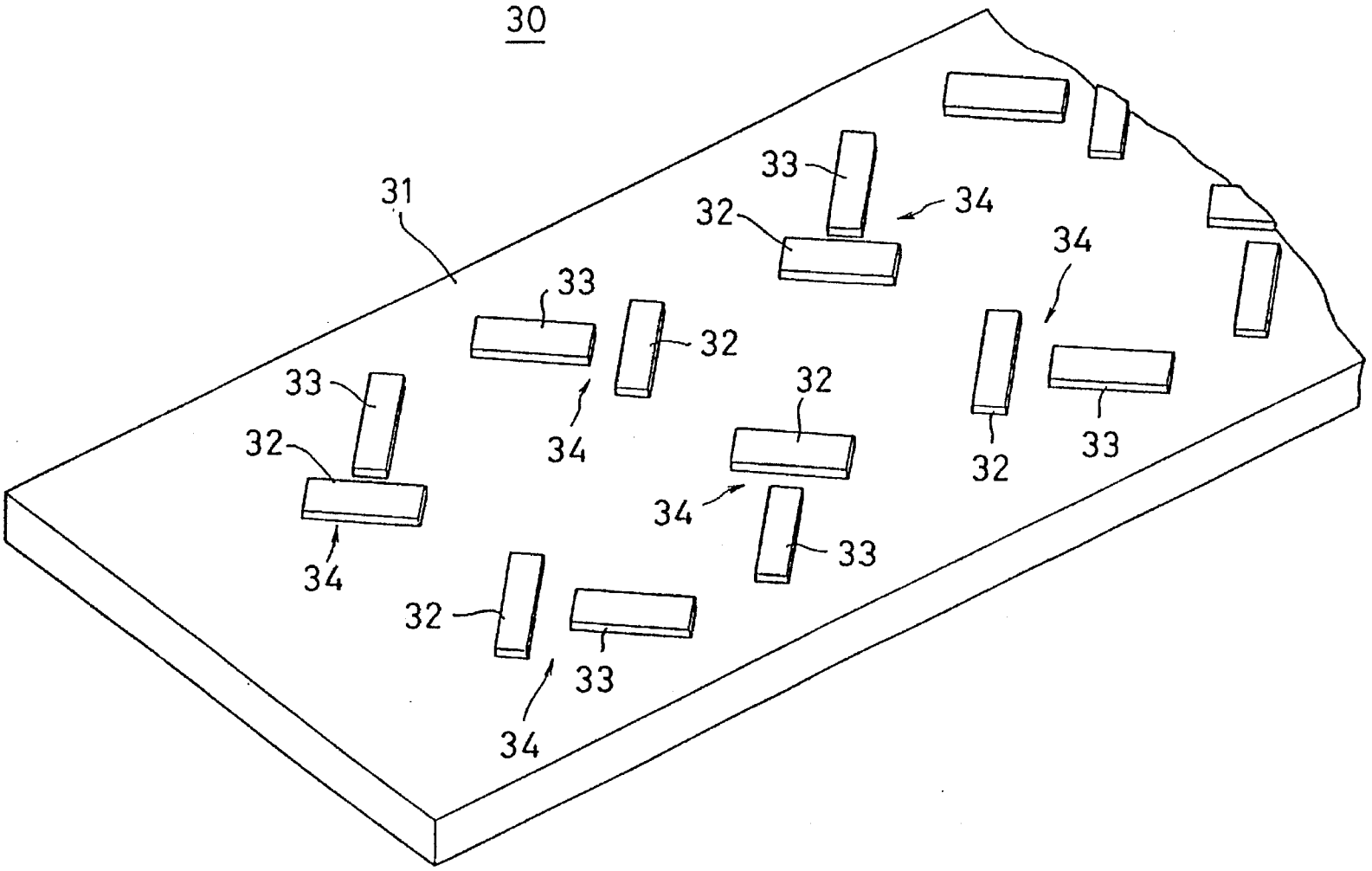
FIG. 6 is a perspective view showing principal portions of a tire slip-preventing construction according to an embodiment of the present invention.
Figure 7:
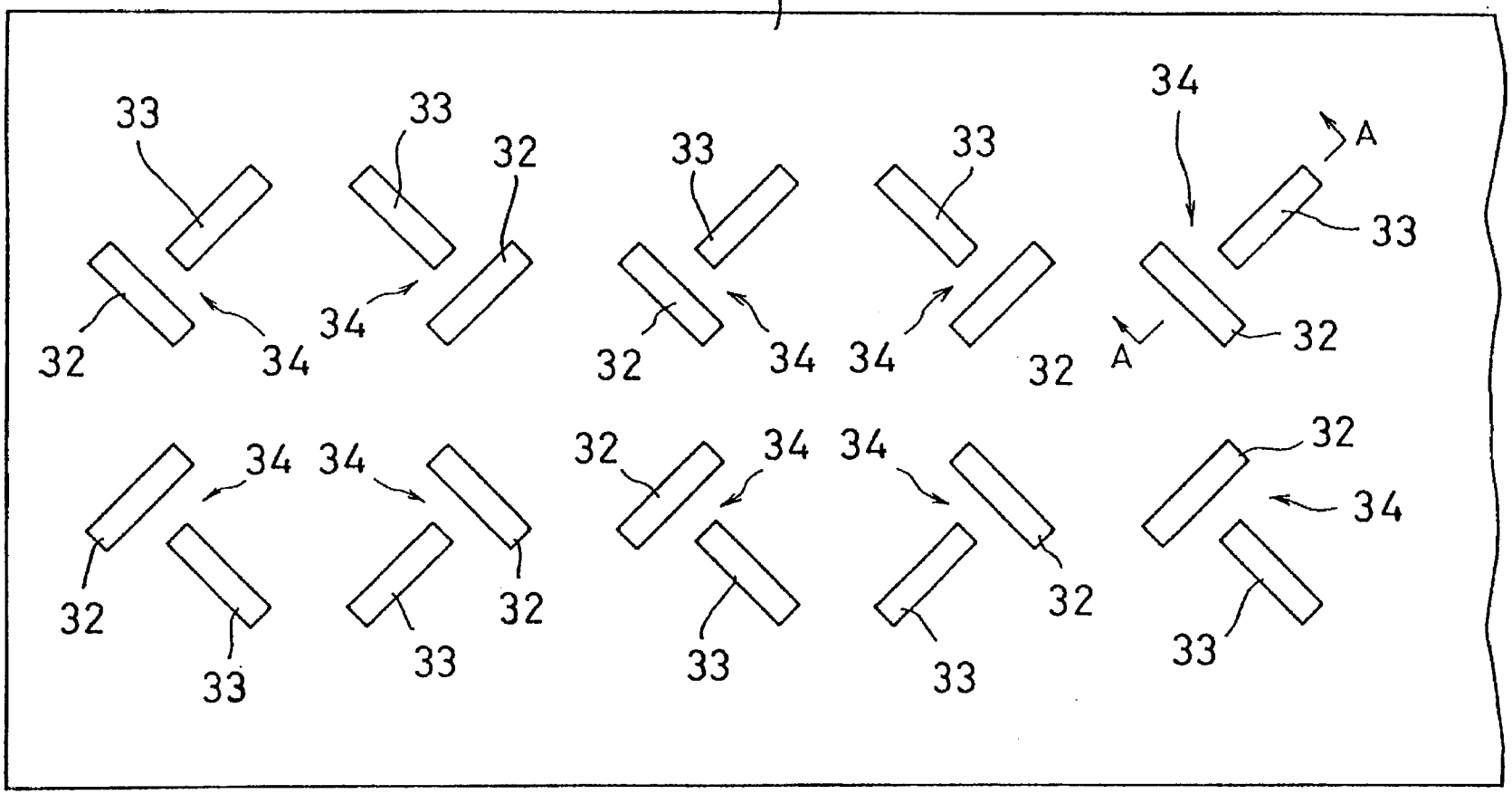
FIG. 7 is a plan view showing principal portions of a floor plate of the tire slip-preventing construction shown in FIG. 6.
Figure 8:
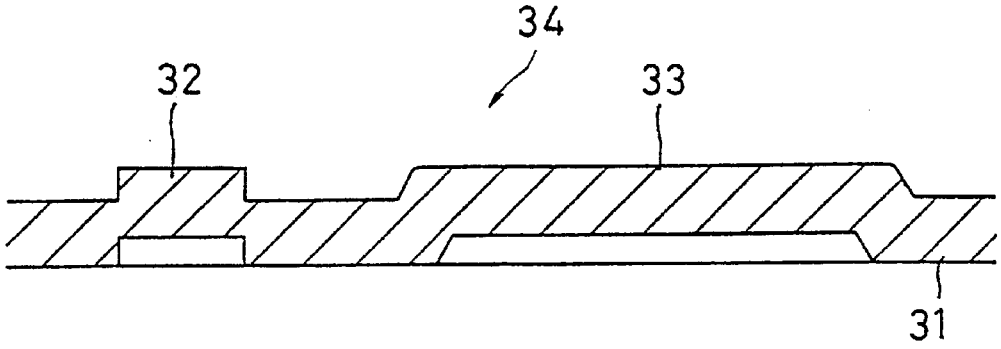
FIG. 8 is a sectional view, showing the floor plate, taken along a line A—A of FIG. 7.

FIG. 6 is a perspective view showing principal portions of a tire slip-preventing construction according to an embodiment of the present invention. FIG. 7 is a plan view showing principal portions of a floor plate of the tire slip-preventing construction shown in FIG. 6. FIG. 8 is a sectional view, showing the floor plate, taken along a line A—A of FIG. 7. In this embodiment, there are formed on a floor plate main body 31, a first projection 32 and a second projection 33, the configurations of which are equal to each other.

That is, a floor panel 30 comprises a rectangular floor plate main body 31. A plurality of projection portions 34 is formed at regular intervals on the upper surface of the floor plate main body 31. The projection portion 34 comprises the rectangular first and second projections 32 and 33. The second projection 33 is spaced at a small interval from the first projection 32 in such a manner that the former is perpendicular to the latter. That is, the first projection 32 and the second projection 33 are disposed in approximately a T-shaped configuration in a plan view.

The corners disposed at the widthwise ends of the first projection 32 and those at the widthwise ends of the second projection 33 form an angle of 90°. The corners disposed at the lengthwise ends of the first projection 32 and those disposed at the lengthwise ends of the second projection 33 are inclined, i.e., form an angle greater than 90°.

A press machine is used to form the first projection 32 and the second projection 33 by drawing. In this embodiment, four groups each consisting of four projection portions 34 are formed simultaneously by drawing. The thickness of the floor plate main body 31 is 3 mm. The thickness of the first projection 32 and that of the second projection 33 are 1.4 mm. The dimension of the first projection 32 and that of the second projection 33 are 25 mm lengthwise and 6 mm widthwise.

As shown in FIGS. 6 and 7, four projection portions 34, each consisting of one first projection 32 and one second projection 33, forming one group are dot-symmetrically disposed on the floor plate main body 31. A plurality of groups is continuously formed at regular intervals on the floor plate main body 31 in the lengthwise direction thereof.

In this embodiment, the first projection 32 and the second projection 33 are arranged in approximately a T-shaped configuration. It is possible to change the direction of the first and second projections 32 and 33. For example, the first and second projections 32 and 33 may be formed at positions obtained by rotating them by 45° clockwise or counterclockwise.

According to the floor plate 30 shown in FIGS. 6 through 8, tires are brought into contact with the corners disposed at the widthwise ends of the first and second projections 32 and 33. Accordingly, an impact force is dispersed and hence the tires can be effectively prevented from slipping on the floor plate 30. Further, the projection portions 34 can be prevented from being cracked against the impact force applied thereto by the tires.

In this embodiment, four groups each consisting of four projection portions 34 are formed simultaneously by drawing. But it is possible to form the first and second projections 32 and 33 one by one by drawing. It is also possible to form two groups each consisting of one first projection 32 and one second projection 33 simultaneously by drawing. It is also possible to form two or three groups or more than four groups simultaneously by drawing.

The floor plate 30 is flat in this embodiment, but it may be formed as shown in FIG. 5. That is, the floor plate main body 31 may be one side-lacking rectangular in section, and the concave 27 is formed on one end of the floor plate main body 31 in the widthwise direction thereof, with the concave 27 extending through the whole length in the lengthwise direction of the floor plate main body 31.

In each of the above-described two embodiments, a part of the edges of the first projection 32 and the second projection 33 are curved or a part thereof are inclined. But all edges may be perpendicular.

Figure 9:
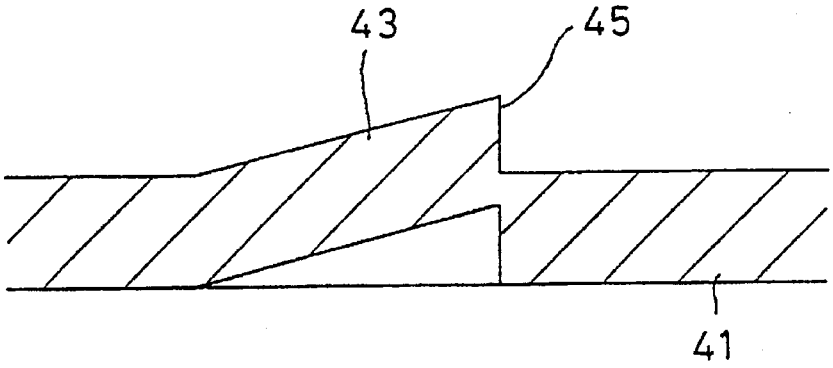
FIG. 9 is a sectional view showing a principal portion of a floor plate of a tire slip-preventing construction according to an embodiment of the present invention.
Figure 10:
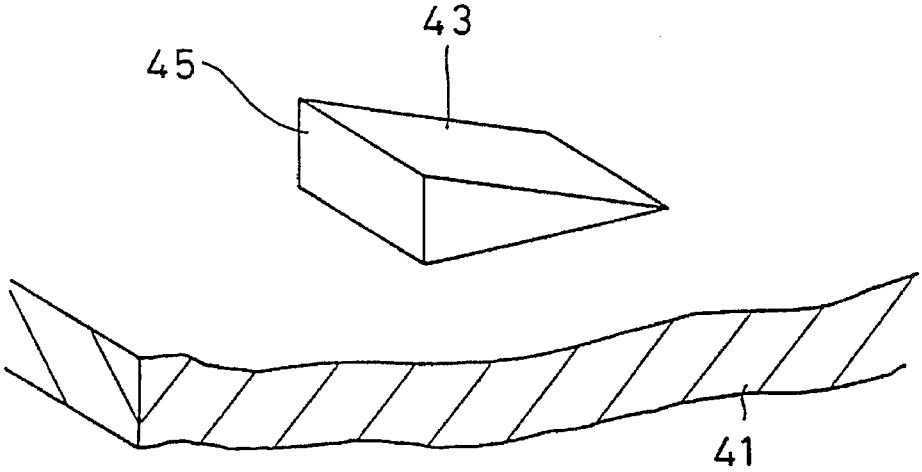
FIG. 10 is a perspective view, with parts broken away in section, showing the floor plate shown in FIG. 9.

FIG. 9 is a sectional view showing principal portions of a tire slip-preventing construction according to still another embodiment of the present invention. FIG. 10 is a perspective view, with parts broken away in section, showing a floor plate shown in FIG. 9. In this embodiment, a plurality of inclined projections are formed on the upper surface of a floor plate main body 41, with one end thereof projecting from the floor plate main body 41. That is, a projection 43 are formed by drawing, with one end 45 thereof projecting from the floor plate main body 41. The lower corner of the projection 43 is perpendicular to the upper surface of the floor plate main body 41 so as to prevent tires from slipping on the floor plate main body 41.

In this embodiment, the upper surface of the projection 43 is inclined from one end thereof toward the other end thereof. If the projections 43 are formed in the same orientation and direction, the projections 43 are not effective for preventing the slip of the tire. Therefore, the projections 43 are arranged with one end 45 of the projections 43 opposed to each other or at random.

Figure 11:
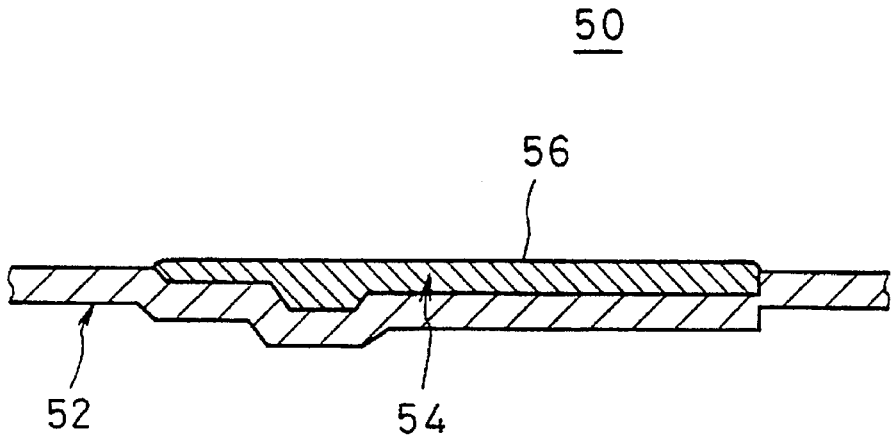
FIG. 11 is a sectional view showing principal portions of a floor plate of a tire slip-preventing construction according to an embodiment of the present invention.

FIG. 11 is a sectional view showing principal portions of a tire slip-preventing construction according to further embodiment of the present invention. The tire slip-preventing construction formed on the upper surface of a floor plate main body is different from those of the above-described embodiments. In the embodiment shown in FIG. 11, the floor plate according to the embodiment shown in FIGS. 1 through 4 is turned upside down to form the projection portion 14 as a concave portion so as to form a slip preventing material layer in the concave portion.

A floor plate 50 comprises a rectangular floor plate main body 52. A plurality of concave portions 54 are formed on the upper surface of the floor plate main body 52 by drawing by spacing them at regular intervals from each other. Similarly to the embodiment shown in FIGS. 1 through 4, four concave portion 54 forming one group are dot-symmetrically disposed on the floor plate main body 52.

A sheet-shaped slip preventing material layer 56 is formed on the concave portion 54 by projecting it from the upper edge therefrom. A mixture of silica sand and a coating material is heated to form a sheet. The sheet is cut according to the size of the concave portion 54 and the cut sheet is inserted thereinto. The sheet is adhered to the concave portion 54 by an adhesive agent or the like.

The slip preventing material layer 56 may be made of plastic, ceramic, rubber or the like. The slip preventing material layer 56 may be inserted into the concave 56 in such a manner that the upper surface thereof is flush with the upper surface of the floor plate main body 52 as shown in FIG. 12.

Although the floor plate according to the embodiment shown in FIGS. 1 through 4 is turned upside down to form the projection portion 14 as the concave portion, the concave portion may be formed by turning the floor plate shown in FIGS. 6 through 8 upside down. That is, the projection portion 34 are formed as the concave portion so as to form the slip preventing material layer 56 on the concave portion, similarly to the embodiments shown in FIGS. 11 and 12.

Figure 12:
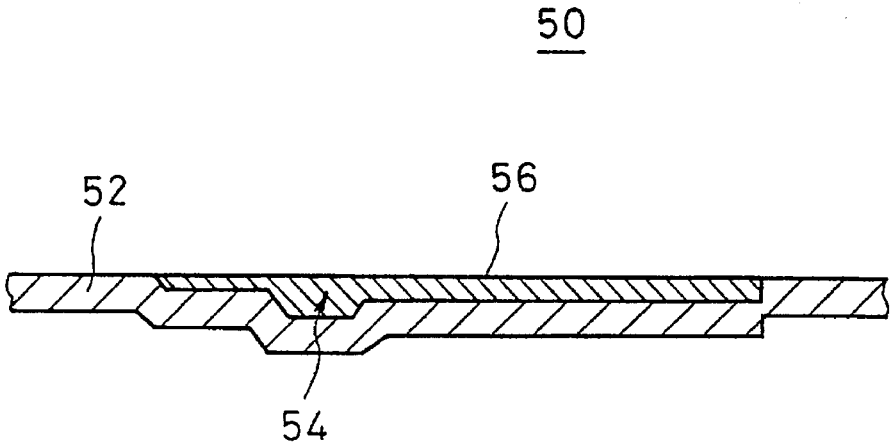
FIG. 12 is a sectional view showing principal portions of a modified floor plate of the floor plate of the tire slip-preventing construction shown in FIG. 11.
Figure 13:
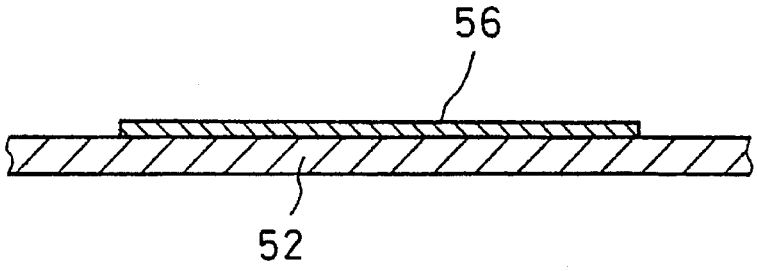
FIG. 13 is a sectional view showing principal portions of a floor plate of a tire slip-preventing construction according to an embodiment of the present invention.
Figure 14:
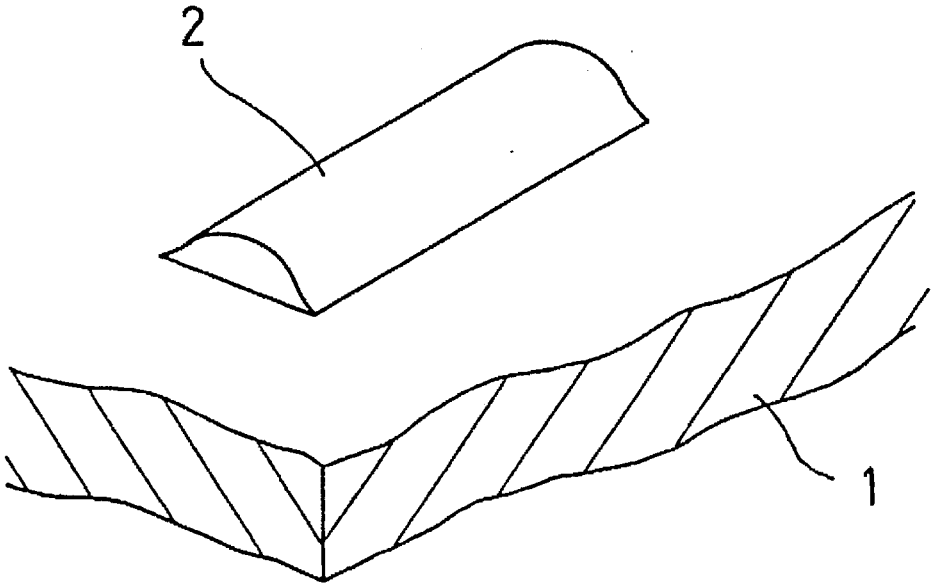
FIG. 14 PRIOR ART
FIG. 14 is a perspective view, with a principal portion broken away in section, showing an example of a conventional tire slip-preventing construction formed on a floor plate.
Figure 15:
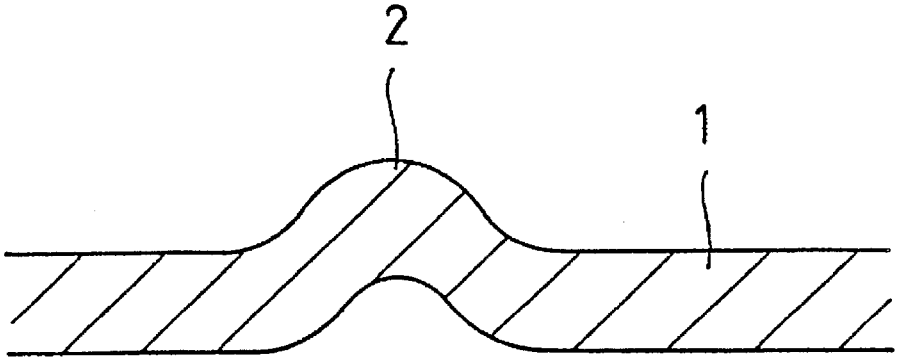
FIG. 15 PRIOR ART
FIG. 15 is a sectional view showing a principal portion of the floor plate of the tire slip-preventing construction shown in FIG. 14.
Figure 16:
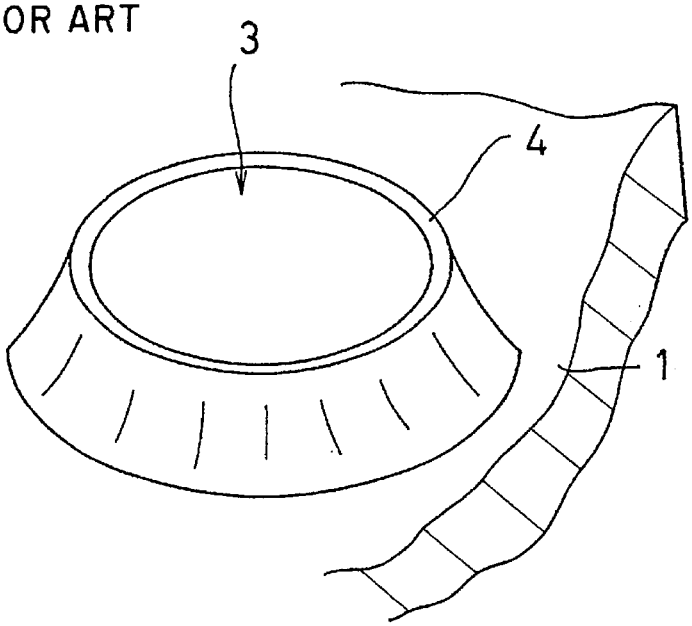
FIG. 16 PRIOR ART
FIG. 16 is a perspective view, with a principal portion broken away, showing another example of a conventional tire slip-preventing construction formed on a floor plate.
Figure 17:
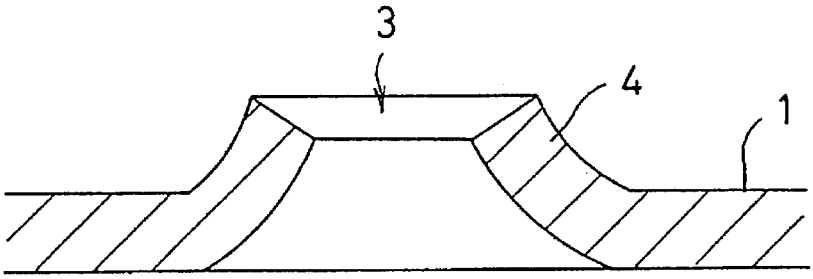
FIG. 17 PRIOR ART
FIG. 17 is a sectional view showing a principal portion of the floor plate of the tire slip-preventing construction shown in FIG. 16.
Figure 18:
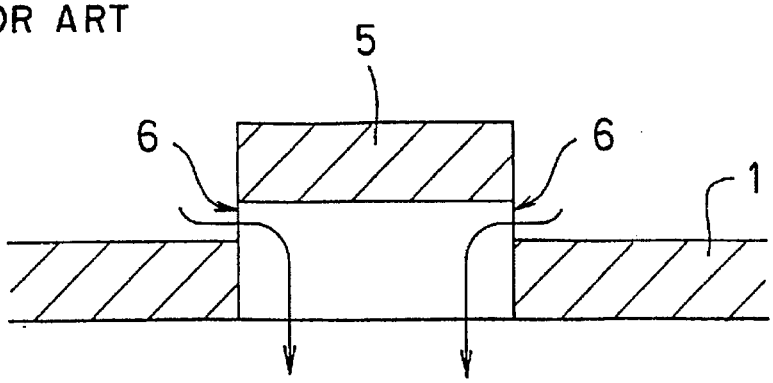
FIG. 18 PRIOR ART
FIG. 18 is a sectional view showing another example of a conventional tire slip-preventing construction formed on a floor plate.

FIG. 13 is a sectional view showing principal portions of a tire slip-preventing construction according to another embodiment of the present invention. In this embodiment, a slip preventing material layer are formed on a floor plate main body unlike the tire slip-preventing construction according to the embodiment shown in FIGS. 11 and 12. That is, in the tire slip-preventing construction according to the embodiment shown in FIGS. 11 and 12, the slip preventing material layer is formed in the concave portion 54 formed on a floor plate main body 52, whereas in the embodiment shown in FIG. 13, the concave portion 54 is not formed but the slip preventing material layer 56 is formed on the upper surface of the floor plate main body 52. Therefore, the slip preventing material layer 56 projects from the upper surface of the floor plate main body 52.

In each of the embodiments shown in FIGS. 11 through 13, each of the floor plate main bodies has a great coefficient of friction owing to the formation of the slip preventing material layer formed on the upper surface of each of the floor plate main bodies. Hence, the tire slip-preventing construction is capable of preventing a tire slip effectively.

The above-described embodiments have been described supposing that the floor plate is installed on a floor of a sky parking-place, but it may be used as a road-covering panel in road repairing. The floor plate according to the present invention is effective for preventing the slip of tires of cars.

While the present invention has been particularly described and shown, it is to be understood that such description is used merely as an illustration and example rather than limitation, and the spirit and scope of the present invention are determined solely by the terms of the appended claims.

What is claimed is:

1. A tire slip-preventing construction formed on a floor plate, comprising:

a generally planar floor plate main body;

a slip preventing portion formed on an upper surface of the floor plate main body;

wherein said slip prevention portion includes a plurality of projection portions (14) each of which has two steps formed by a first projecting portion (12 ) and a second projecting portion (13) which are formed on top of the first projecting portion at a position to create a first step up from the floor plate main body to the first projecting portion and a second step up from the first projecting portion to the second projecting portion; and wherein said floor plate and said first projecting portion and said second projecting portion are constructed of the same integrally formed piece.

2. The tire slip-preventing construction according to claim 1, wherein the slip preventing portion includes a plurality of projection portions; and each of said projection portions having an end which forms about 90° angle with the top of the floor plate.

3. A tire slip-preventing construction formed on a floor plate, comprising:

a floor plate main body; and a slip preventing portion formed on an upper surface of the floor plate main body;

wherein the slip preventing portion includes a plurality of projection portions;

wherein each of said projection portions comprises a first projection formed on the upper surface of the floor plate main body and a second projection formed on the upper surface of the first projection portion and that of the floor plate main body, with the second projection extending from a certain point disposed on one side of the first projection toward a certain point disposed on the upper surface of the floor plate main body.

4. The tire slip-preventing construction according to claim 3, wherein the first projection comprises a wide portion disposed on one side thereof and a narrow portion disposed on an opposite side thereof.

5. The tire slip-preventing construction according to claim 4, wherein side surfaces of the narrow portion are inclined symmetrically.

6. The tire slip-preventing construction according to claim 5, wherein a plurality of said projection portions form a group which is arranged dot-symmetrically.

7. The tire slip-preventing construction according to claim 6, wherein a plurality of said projection portions form a group which is arranged dot-symmetrically, with the second projections directed toward a center of dot-symmetry.

8. The tire slip-preventing construction according to claim 7, wherein four projection portions forming a group are arranged dot-symmetrically, with the second projections directed toward the center of dot-symmetry.

9. The tire slip-preventing construction according to claim 7 and 8, wherein a plurality of groups each consisting of a plurality of the projection portions is formed at regular intervals on the upper surface of the floor plate main body in a lengthwise direction thereof.

10. The tire slip-preventing construction according to claim 4 or 6, wherein a plurality of the floor plate main bodies narrow and long are arranged to form a floor surface; and a plurality of groups each consisting of four projection portions forming a group is formed continuously on the upper surface of each of the floor plate main bodies in a lengthwise direction thereof.

11. A tire slip-preventing construction formed on a floor plate, comprising:

a floor plate main body;

a slip preventing portion formed on an upper surface of the floor plate main body;

wherein the slip preventing portion includes a plurality of projection portions; and each of said projection portions having an end which forms about a 90° angle with the top of the floor plate;

wherein each projection portion comprises two projections having ends extending in a lengthwise direction which form about a 90° angle with the top of the floor plate; and the two projections are arranged in approximately a T-configuration; and wherein a plurality of groups each consisting of the two projections are arranged dot-symmetrically on the upper surface of the floor plate main body.

12. The tire slip-preventing construction according to claim 3 or 11, wherein the floor plate main body is made of a steel plate; and each projection portion is formed by drawing.

13. The tire slip-preventing construction according to claim 12, wherein the thickness of each said projection portion is approximately half of that of said floor plate main body.

14. The tire slip-preventing construction according to claim 13, wherein at least four groups each consisting of a plurality of said projection portions are formed simultaneously by drawing.

15. A tire slip-preventing construction formed on a floor plate, comprising:

a floor plate main body;

a slip preventing portion formed on an upper surface of the floor plate main body;

wherein the slip preventing portion includes a plurality of projection portions;

wherein each projection portion comprises two projections arranged in approximately a T-configuration;

wherein a plurality of groups each consisting of the two projections are arranged dot-symmetrically on the upper surface of the floor plate main body; and wherein four groups each consisting of the two projections are arranged dot-symmetrically on the upper surface of the floor plate main body.

16. The tire slip-preventing construction according to claim 11, wherein a plurality of groups each consisting of the two projection portions is formed at regular intervals on the upper surface of the floor plate main body in a lengthwise direction thereof.

17. The tire slip-preventing construction according to claim 11, wherein a plurality of the floor plate main bodies narrow and long are arranged to form a floor surface; and a plurality of groups each consisting of the two projections forming a group is formed continuously on the upper surface of each of the floor plate main bodies in a lengthwise direction thereof.

18. A tire slip-preventing construction formed on a floor plate, comprising:

a floor plate main body;

a slip preventing portion formed on an upper surface of the floor plate main body;

wherein the slip preventing portion comprises a slip preventing material layer formed on the upper surface of the floor plate main body;

wherein the slip preventing material layer are formed on a concave portion formed on the upper surface of the floor plate main body; and wherein the slip preventing material layer are formed on the concave portion so that the slip preventing material layer projects from the upper surface of the floor plate main body; and wherein a plurality of groups each consisting of a plurality of the concave portions is arranged dot-symmetrically.

19. The tire slip-preventing construction according to claim 18, wherein each of said concave portions comprises two concaves which are rectangular in section; and the two concaves are arranged in approximately a T-configuration.

* * * * *